United States Patent [19]

Frei et al.

[11] Patent Number: 4,696,253

[45] Date of Patent: Sep. 29, 1987

[54] APPARATUS FOR APPLYING A STRIP-SHAPED POWDER LAYER ONTO A WELD SEAM OF CONTAINERS

[75] Inventors: Siegfried Frei, Schoeckstrasse 3, 9000 St. Gallen; Ernst Hohl, Wittenbach, both of Switzerland

[73] Assignee: Siegfried Frei, St. Gallen, Switzerland

[21] Appl. No.: 844,347

[22] Filed: Mar. 26, 1986

Related U.S. Application Data

[62] Division of Ser. No. 589,346, Mar. 14, 1984, Pat. No. 4,588,605.

[30] Foreign Application Priority Data

Mar. 21, 1983 [CH] Switzerland ..... 1537/83

[51] Int. Cl.[4] ..... B05B 5/02; B05B 13/06

[52] U.S. Cl. ..... 118/308; 427/28; 427/33; 427/181; 118/622; 118/624; 118/312; 118/317

[58] Field of Search ..... 427/28, 33, 181; 118/308, 622, 624, 312, 317, 326

[56] References Cited

U.S. PATENT DOCUMENTS

| | | | |
|---|---|---|---|
| 2,804,708 | 9/1957 | Simjian | 118/624 X |
| 3,248,253 | 4/1966 | Barford et al. | 118/622 X |
| 3,713,862 | 1/1973 | Winkless | 118/624 X |
| 4,205,621 | 6/1980 | Payne et al. | 118/622 |
| 4,212,266 | 7/1980 | Payne et al. | 118/622 X |
| 4,215,648 | 8/1980 | Stamets et al. | 118/622 |
| 4,346,667 | 8/1982 | Stamets et al. | 118/622 |

*Primary Examiner*—Shrive P. Beck

*Attorney, Agent, or Firm*—Werner W. Kleeman

[57] ABSTRACT

The apparatus for forming and applying a substantially strip-shaped powder layer onto a weld seam of a can body, comprises a spray head including a spray chamber. A powder supply device supplies a powder composed of powder particles transported by a carrier gas and in the form of a substantially bundled powder jet into the spray chamber of the spray head. The spray chamber is provided with a spray opening which is open towards the weld seam and is located opposite the weld seam. Structure is provided for establishing a pressure in the spray chamber which is lower than the pressure of the surrounding stmosphere to ensure retention of the bundled powder jet entering the spray chamber and to prevent formation of a spray cloud of the powder particles of the bundled powder jet composed of the powder transported by the carrier gas. There is also provided structure for diverting at least part of the powder particles of the bundles powder jet from the spray chamber in the direction of the weld seam and for depositing such diverted powder particles onto the weld seam in the form of a substantially strip-shaped powder layer.

5 Claims, 6 Drawing Figures

FIG. 1
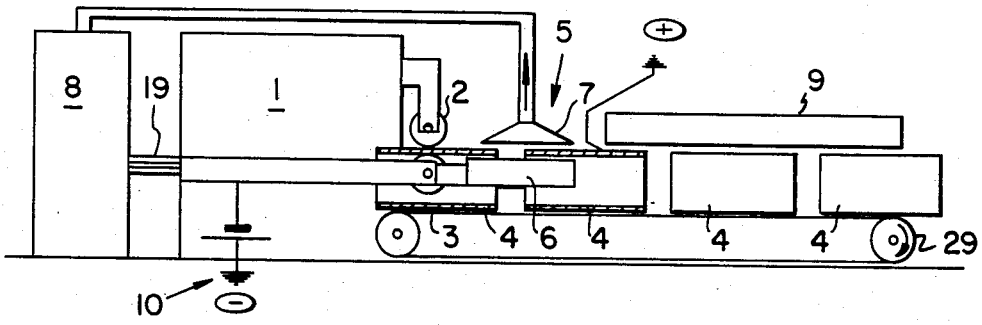
FIG. 2
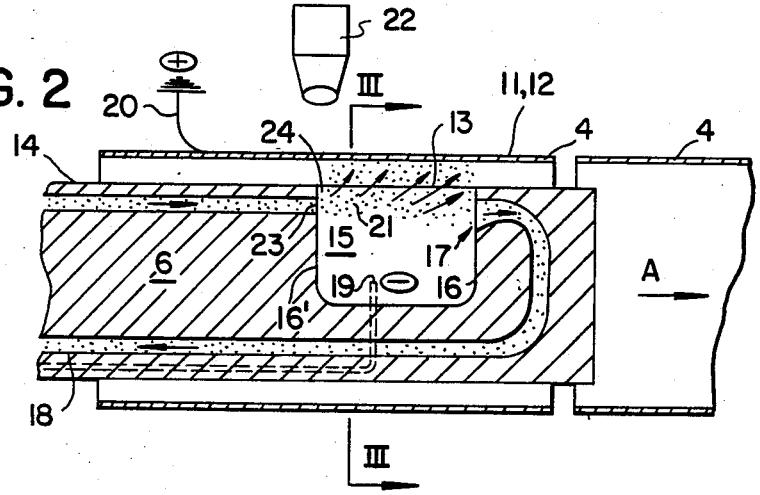
FIG. 3
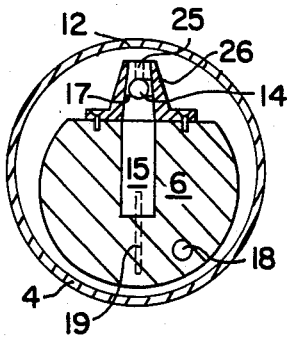
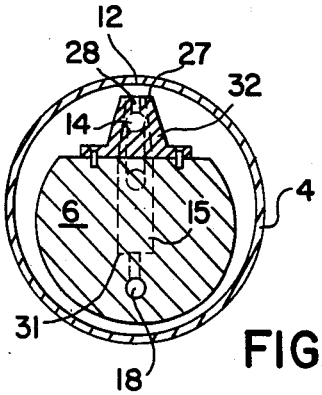
FIG.6

APPARATUS FOR APPLYING A STRIP-SHAPED POWDER LAYER ONTO A WELD SEAM OF CONTAINERS

CROSS-REFERENCE TO RELATED APPLICATIONS

This application is a divisional application of our U.S. patent application Ser. No. 06/589,346, filed on Mar. 14, 1984 and entitled "METHOD OF AND ARRANGEMENT FOR APPLYING A STRIP-SHAPED POWDER LAYER ON A WELD SEAM OF CONTAINERS, AND A CONTAINER" now U.S. Pat. No. 4,588,605, granted May 13, 1986. This application is also related to our copending U.S. application Ser. No. 06/797,919, filed Nov. 14, 1985, and entitled "METHOD AND APPARATUS FOR APPLYING STRIP-SHAPED POWDER LAYER TO A CAN BODY OR THE LIKE, AND POWDER-CARRYING CAN BODY" and now U.S. Pat. No. 4,661,379, and which application is a continuation-in-part of our U.S. application Ser. No. 06/628,129, filed July 9, 1984, now abandoned, which, in turn, is a continuation of our U.S. application Ser. No. 06/478,279, filed Mar. 24, 1983, now abandoned.

BACKGROUND OF THE INVENTION

The present invention relates to a new and improved apparatus or arrangement for applying a substantially strip-shaped powder layer onto a weld seam of a can body or container, such as food cans and the like.

Apparatuses or arrangements of the above-mentioned general type are known in the art. Swiss Pat. No. 603,249 discloses a powder coating arrangement in which a stream of powder/air mixture is brought into a chamber which is open toward the weld seam and braked in the chamber by inserts located transverse to the direction of the stream which is distributed and deflected to the outlet opening. The powder particles which forcibly adhere to the deflecting plates must be removed with an additional stream from the spray chamber and blown to the weld seam. In the sense of flow technique the arrangement has many deficiencies and thereby it possesses a high consumption of transport and suction air, as well as reprocessed powder. With failing of one container or can, the whole powder cloud must be aspirated through a suction hood provided above the arrangement.

Another powder applying arrangement is disclosed in the U.S. Pat. No. 4,215,648, granted Aug. 5, 1980. In this arrangement powder is separated from the carrier gas by centrifugal separation and supplied in a tight stream at an acute angle to a spot to be coated. The powder stream is blown to the weld seam with an air cushion, for example through a porous wall of the spray chamber. In this arrangement the whole quantity of powder which has not adhered to the weld seam must be aspirated between the successive containers by outward suction. Then the powder particles are pulled because of the negative pressure formed there, inwardly of the container or can in all regions which communicate with the surroundings and deposited at locations which need not be coated, for example on the outer side or surface of the container. In addition to a great consumption of powder and energy for pressure and suction air, it is impossible to provide a small coating extending along the weld seam and having a constant thickness, since there is no possibility of dosing the powder quantity to be applied.

U.S. Pat. Nos. 4,212,266, granted July 15, 1980, and 4,205,621, granted June 3, 1980, disclose a powder applying arrangement in which the air stream supplied parallel to a powder supply conduit blows the powder from the arrangement upwardly onto the weld seam. Return of the particles which have moved upwardly but not adhered to the weld seam is performed by a collector located in the reaar part (downstream) of the arrangement. In the foregoing prior art constructions the collector or catcher communicates with the arrangement via a slot under the wall opposite to the supply and air conduits.

SUMMARY OF THE INVENTION

Accordingly, it is an important object of the present invention to eliminate the disadvantages of the known apparatuses of the above-mentioned type.

In particular, it is a further noteworthy object of the present invention to provide an improved construction of apparatus for applying a substantially strip-shaped powder layer on a weld seam of containers or cans or the like in a manner which saves material and energy during operation of such apparatus.

Still another significant object of the present invention is to provide an improved apparatus for applying in a highly efficient and economical fashion a substantially strip-shaped powder layer onto a weld seam of a can body or container by avoiding the formation of a spray cloud of powder particles of a bundled powder jet composed of powder transported by a carrier gas within a spray chamber of a spray head.

In keeping with the foregoing object, it is a further noteworthy object of the invention to provide an improved construction of apparatus for forming and applying a substantially strip-shaped powder layer onto a weld seam of a can body or can or container or the like by using a spray head including a spray chamber within which there is established a pressure which is lower than the pressure of the surrounding atmosphere.

Yet a further important object of the present invention is concerned with the construction of a new and improved apparatus for forming and applying a substantially strip-shaped powder layer onto a weld seam of a can body or can or container or the like by using a spray head including a spray chamber within which there is established a pressure which is lower than the pressure of the surrounding atmosphere, so that there is retained a bundled powder jet formation within the spray chamber while precluding the formation of any spray cloud of powder particles of such bundled powder jet within the spray chamber.

Another significant object of the present invention is concerned with a new and improved construction of apparatus for forming and applying a substantially strip-shaped powder layer onto a weld seam of a can body or can or container or the like, which apparatus is relatively simple in design, economical in its construction, highly reliable in operation, not readily subject to breakdown or malfunction and requires a minimum of maintenance and servicing.

Now in order to implement these and still further objects of the invention, which will become more readily apparent as the description proceeds, the inventive apparatus for forming and applying a substantially strip-shaped powder layer onto a weld seam of a can body, comprises spray head means including a spray chamber. Means serve for supplying a powder composed of powder particles transported by a carrier gas and in the form of a substantially bundled powder jet into the spray chamber of the spray head. The spray chamber is provided with a spray opening which is open towards the weld seam and is located opposite the weld seam. Also provided are means for establishing a pressure in the spray chamber which is lower than the pressure of the surrounding atmosphere so as to ensure retention of the bundled powder jet entering the spray chamber and to prevent formation of a spray cloud of the powder particles of the bundled powder jet composed of the powder transported by the carrier gas. Additionally, there are provided means for diverting at least part of the powder particles of the bundled powder jet from the spray chamber in the direction of the weld seam and for depositing the diverted powder particles onto the weld seam in the form of a substantially strip-shaped powder layer.

The provision of a lower pressure in the spray chamber and the continuous aspiration of the supplied powder inside the spray chamber prevents discharging the powder particles into the surrounding atmosphere both during the coating process, and in the absence of one of several cans or can bodies or containers in the application region.

The absence in the inventive arrangement or apparatus of guiding, distributing and deflecting means which conventionally cause powder deposits, allows the provision or design of the inventive arrangement or apparatus without means for eliminating the same. In the event of production interruptions, discharge of powder from the spray head can be momentarily interrupted by turning off the voltage of the electrodes constituting the powder particle diverting means, without interrupting the powder flow. The powder or powder particles circulating in the spray head can be supplied back into the spray head from the processing device uncleaned, since there is no possibility of dirtying or contaminating the same. It is to be understood that only a small reprocessing device suffices for the small quantity of powder particles extending through the spaces between the successive containers and caught by the outer suction.

Because of the direct dependency of the powder quantity separated from the powder stream or bundled powder jet onto the weld seam and upon the amplitude of the voltage applied to the electrodes, the application thickness of the powder on the weld seam can be adjusted each time from outside or externally, or boundary conditions such as air moisture, distance of the weld seam from the powder stream, and so forth can be compensated. Because of the lower pressure prevailing in the spray opening or spray chamber relative to the surroundings, lateral limiting brushes along the spray opening, and which previously had to be absolutely provided, now can be dispensed with in the inventive arrangement or apparatus.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 1 is a view schematically showing a powder applying apparatus or arrangement on a welding machine for welding a longitudinal weld seam of can bodies or containers;

FIG. 2 is a view showing a vertical section through a spray head of the applying apparatus in accordance with the present invention;

FIG. 3 is a view showing a section of the spray head, taken substantially along the line III—III in FIG. 2;

FIG. 6 is a view showing a section taken substantially along the line VI—VI in FIG. 5.

DETAILED DESCRIPTION OF THE PREFERRED EMBODIMENTS

Figure 4:
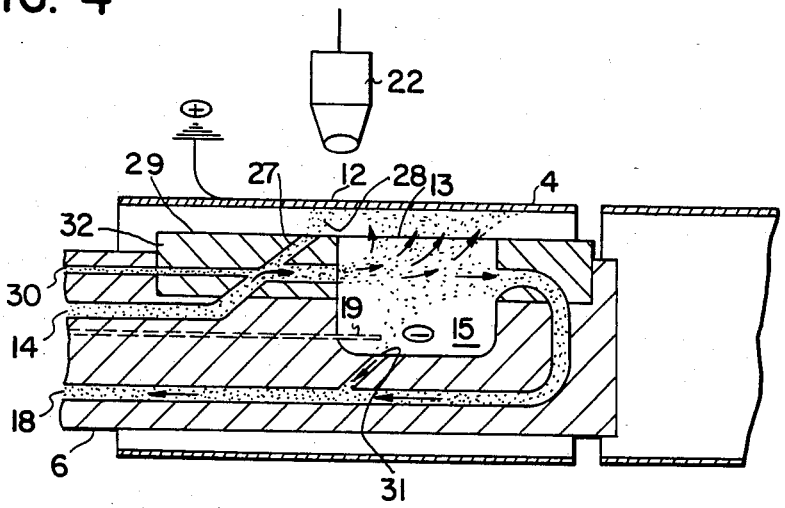
FIG. 4 is a view showing a longitudinal vertical section of the spray head in accordance with another embodiment of the present invention.

Processing, reprocessing and melting of a powder in a homogenous layer on a weld seam are not the objects of the present invention and are described only to the extent necessary for understanding the present invention.

FIG. 1 schematically shows a known seam-welding machine 1 with electrode rollers 2 and 3, individual newly welded can bodies or cans or containers 4, a powder application arrangement 5 with a spray head 6, an outer suction device 7 and a combined processing and reprocessing device 8, as well as a known heating device 9 for melting the powder on the seam. An electrical device for production of high voltage for charging the powder is shown symbolically and identified with reference numeral 10. It is to be understood that instead of equipping the welding machine with roller electrodes, a machine with an energy jet welding head, for example a laser can be used.

The powder spray head 6 is shown in FIG. 2 on an enlarged scale in a longitudinal section.

A container or can body or can 4 is also shown over the spray head 6. It passes the spray head 6 from the left side to the right side in accordance with the arrow A. An upper cutting or cut surface 11 through the can body or container 4 runs exactly in a weld seam 12 of such can body or container 4 and lies above a spray opening 13.

A powder supply conduit 14 defining a powder supply device opens substantially parallel to the weld seam 12 into a substantially slot-shaped spray chamber or recess 15 provided in the spray head 6. This substantially slot-shaped spray chamber 15 may advantageously possess a width which substantially corresponds to the diameter of the bundled powder jet 24. An inlet opening 17 of a conduit 18, defining a suction conduit, is located in a rectilinear extension of the powder supply conduit 14 in the opposite side wall of the spray chamber or recess 15. The suction conduit 18 communicates with a vacuum generator in the processing device 8. The suction conduit 18 establishes a pressure in the spray chamber 15 which is lower than the pressure of the surrounding atmosphere to ensure retention of the bundled powder jet 24, advantageously possessing a defined or predetermined diameter, entering such spray chamber and to prevent formation of a spray cloud of the powder particles of the bundled powder jet 24 composed of the powder transported by a carrier gas, typically air. This suction conduit 18 also serves for aspirating the carrier gas from the spray chamber 15 in a predetermined volume per unit of time. The powder supply conduit 14 advantageously may supply into the spray chamber 15 the carrier gas in a volume per unit of time which is smaller than the volume per unit of time of the carrier gas aspirated from the spray chamber 15 by the suction conduit 18. Advantageously, the opening 17 of the suction conduit 18 is formed to be substantially funnel-shaped so as to provide an enlarged mouth. A needle-shaped electrode 19 extends into the lower region of the spray chamber or recess 15. It is connected with the adjustable high voltage source 10 which is not shown in FIG. 2. A sliding contact 20 touches the can body or container 4 which moves directly over the spray head 6, and this sliding contact 20 applies to the can body or container 4 a voltage which is opposite to that of the electrode 19. It has been recognized as favorable when the can body or container 4 is connected with a positive terminal or pole, whereas powder particles 21 supplied in a carrier gas through the powder supply conduit 14 into the spray chamber or recess 15 in the form of a substantially bundled powder jet 24 are charged negatively via the electrode or electrode means 19. A sensor 22 is arranged outside the spray head 6 to monitor the presence of the container or can body 4 in the region of the spray chamber 15.

The powder particles 21 transported in the powder supply conduit 14 by the carrier gas are discharged from a mouth or outlet opening 23 of the powder supply conduit 14 in the form of the bundled powder jet 24 and flow directly, in a predetermined or natural flight path, in the direction of the inlet opening 17 in the opposite side wall 16 from which it is supplied back by the suction action of the suction conduit 18 to the processing device 8. The mouth or outlet opening 23 of the powder supply conduit 14 opens at the side wall 16' of the spray chamber 15 and which side wall 16' is located opposite to the side wall 16. The vacuum source is formed so that at least the whole carrier gas quantity as well as the powder particles 21 contained therein, which are supplied through the powder supply conduit 14 to the spray chamber or recess 15, are aspirated again through the conduit 18. As a result, the powder particles 21 neither abandon the spray chamber or recess 15, nor return back to it.

However, when the sensor 22 first detects the presence of a can body or container 4, the needle-shaped electrode 19 or several electrodes are connected with the negative terminal or pole of the high voltage source 10. The powder particles which traverse the spray chamber or recess 15 in the form of the bundled jet 24 extending in a substantially rectilinear natural path are statically charged. A part of these powder particles 21, which have a negative charge, are pulled or attracted by the can body or container 4 having a positive charge and flow through the spray opening 13 of the spray chamber 15 in the direction of the positively charged can body or container 4 and remain adhering on the latter. Depending upon the magnitude of the voltage on the electrode 19, more or fewer particles are transferred onto the can body or container 4.

In the absence of the can body or container 4 or in the presence of a distance or spacing between two successive can bodies or containers 4 which is greater than a predetermined value, the voltage on the electrode 19 is interrupted by the sensor 22. The powder particles which are continuously supplied from the powder supply conduit 14 are then aspirated as a whole by the suction conduit 18 and transported to the processing device 8.

For obtaining a laterally sharply limited powder strip or strip-shaped powder layer which covers only the region of the weld seam and the immediately adjacent portion or region, the spray head 6 is provided with guide plates 25 which deflect the particles 21 flowing to the container or can body 4 toward the weld seam region 12, as can be seen from FIG. 3. Advantageously, the guide plates 25 are a part of an exchangeable adaptor 26 which can be placed on the spray head 4 through the spray chamber 15. Since the spray chamber 15 is under the action of a permanent negative pressure, the powder particles 21 flowing to the can body or container 4 tend to deposit in the central region of the weld seam 12. Consequently lateral sealing members, such as for example brushes, are superfluous.

Figure 5:
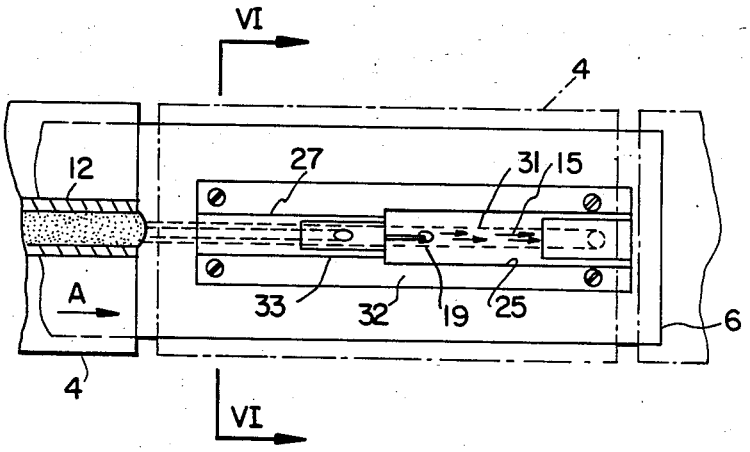
FIG. 5 is a plan view of the spray head shown in FIG. 4.

In accordance with a further embodiment of the invention which differs from that shown in FIGS. 2 and 3, the spray head 6 of this modified embodiment as shown in FIGS. 4 to 6 has a spray nozzle 27 defining a spraying or spray opening located prior to or upstream of the spray region of the spray chamber or recess 15. A fine powder stream 28 can discharge exactly onto the weld seam 12 from the spray nozzle 27. This fine powder stream 28 discharges the powder particles directly onto the weld seam 12 at an obtuse angle, as shown in FIG. 4. The powder or powder particle discharge or stream 28 from the spray nozzle 27 is not loaded or charged. A small loading or charging of the powder particles can be provided within some limits by virtue of the friction of the powder particles 21 in the powder supply conduit 14. The adherence of the powder particles 21 on the weld seam 12 is provided either by arranging the spray head 6 directly at the outlet on the weld seam 12, or by maintaining the weld seam 12 hot so that sticking of the particles 21 on the weld seam 12 takes place.

The spray nozzle 27 can be connected directly with the powder supply conduit 14, and such connection can be made in an arcuate or angled portion 29 of the powder supply conduit 14. For interruption of the powder stream 28, a further conduit 30 is provided and opens into the arcuate portion 29. The further conduit 30 can deflect, by means of a fine air jet, the powder particles 21 in the absence of a container or can body 4 through the powder supply conduit 14 toward the spray chamber or recess 15.

The powder particles 21 thrown or propelled by the spray nozzle 27 onto the weld seam 12 and not adhering to such weld seam 12 are aspirated into the spray chamber or recess 15 because of the low pressure in the latter and transported by suction through the suction conduit 18 back to the processing device 8. For preventing accumulation of the powder particles 21 falling onto the bottom or floor of the spray chamber or recess 15, especially when additional air is blown through the conduit 30, a further suction opening 31 can be provided in the spray chamber or recess 15 as shown in FIG. 4.

FIG. 5 shows the embodiment of FIG. 4 from above. The distance or spacing between the guide plates 25 substantially corresponds to the width of the powder strip to be produced or deposited on the container or can body 4. The width of the spray nozzle or spray opening 27 substantially corresponds to the width of the weld seam 12. It can be formed round or as a slot lying parallel to the weld seam 12. The spray nozzle or spray opening 27 can either directly open on the weld seam 12, or it can lie at the bottom of a slot 33 leading to the opening 13. Powder particles which have not adhered to the weld seam 12 travel through the slot 33 to the spray chamber or recess 15 and from there into the suction conduit 18.

The guide plates 25 and the slot 33 can be a part of an adaptor 32 which can be fitted onto the spray head 6. The spray head 6, provided with a respective adaptor 32, can be used for different application types and widths.

In the sectional view depicted in FIG. 6, a part of the powder particles 21 leave the powder supply conduit 14 at the bottom of the slot 33. The lateral guidance which prevents dissipation of the powder particles 21 near the weld seam 12 can be clearly seen here.

In the above-described examples the conveyor device for the powder particles 21, in other words the direction of conveying the powder particles 21 by the spray head 6 is in the same sense as the conventional transport device conveys the containers or can bodies 4. It is to be understood, however, that the can bodies or containers 4 can be transported in the opposite direction to the action of the spray head 6.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for forming and applying a substantially strip-shaped powder layer onto a weld seam of a can body, comprising:

spray head means including a spray chamber;

means for supplying a powder composed of powder particles transported by a carrier gas in the form of a substantially bundled powder jet into said spray chamber of said spray head;

said spray chamber being provided with a spray opening which is open towards the weld seam and is located opposite the weld seam;

means for establishing a pressure in the spray chamber which is lower than the pressure of the surrounding atmosphere to ensure retention of the bundled powder jet entering said spray chamber and to prevent formation of a spray cloud of the powder particles of said bundled powder jet composed of the powder transported by the carrier gas;

means for diverting at least part of the powder particles of the bundled powder jet from the spray chamber in the direction of the weld seam and for depositing said diverted powder particles onto the weld seam in the form of a substantially strip-shaped powder layer;

said powder supplying means including a supply conduit which supplies the powder particles into said spray chamber so that they travel in a natural flight path;

said pressure establishing means including a suction conduit having an inlet opening located in said natural flight path of the powder particles; and a spray nozzle located upstream of said spray chamber with respect to a predetermined direction of travel of the can body and arranged to supply the powder particles at an obtuse angle directly onto the weld seam.

2. The apparatus as defined in claim 1, further including:

a slot communicating with said spray chamber; and said spray nozzle being open into said slot under the weld seam.

3. The apparatus as defined in claim 1, wherein:

said supply conduit has an arcuate portion in which said spray nozzle starts.

4. The apparatus as defined in claim 1, further including:

a pressure gas conduit arranged so that a pressure gas stream discharged therefrom prevents the powder particles in said supply conduit from exiting through said spray nozzle.

5. An apparatus for forming and applying a substantially strip-shaped powder layer onto a weld seam of a can body, comprising:

spray head means including a spray chamber;

means for supplying a powder composed of powder particles transported by a carrier gas in the form of a substantially bundled powder jet into said spray chamber of said spray head;

said spray chamber being provided with a spray opening which is open towards the weld seam and is located opposite the weld seam;

means for establishing a pressure in the spray chamber which is lower than the pressure of the surrounding atmosphere to ensure retention of the bundled powder jet entering said spray chamber and to prevent formation of a spray cloud of the powder particles of said bundled powder jet composed of the powder transported by the carrier gas;

means for diverting at least part of the powder particles of the bundled powder jet from the spray chamber in the direction of the weld seam and for depositing said diverted powder particles onto the weld seam in the form of a substantially strip-shaped powder layer;

said powder supplying means including a supply conduit which supplies the powder particles into said spray chamber so that they travel in a natural flight path;

said pressure establishing means including a suction conduit having an inlet opening located in said natural flight path of the powder particles; and said supply conduit being arranged so as to supply the powder particles in a direction which is opposite to a predetermined transport direction of the can body.

* * * * *